US009196177B2

(12) United States Patent
English

(10) Patent No.: US 9,196,177 B2
(45) Date of Patent: Nov. 24, 2015

(54) DISPLAY FOR MULTIPLE TYPES OF DOOR HANDLES

(75) Inventor: Larry Nolan English, Deer Park, IL (US)

(73) Assignee: Wild August LLC, Chicago, IL (US)

( * ) Notice: Subject to any disclaimer, the term of this patent is extended or adjusted under 35 U.S.C. 154(b) by 56 days.

(21) Appl. No.: 13/540,534

(22) Filed: Jul. 2, 2012

(65) Prior Publication Data

US 2014/0001130 A1 Jan. 2, 2014

Related U.S. Application Data

(60) Provisional application No. 61/502,432, filed on Jun. 29, 2011.

(51) Int. Cl.
*G09F 3/18* (2006.01)
*G09F 7/18* (2006.01)

(52) U.S. Cl.
CPC ..... *G09F 7/18* (2013.01)

(58) Field of Classification Search
USPC ..... 248/214, 230.1, 230.2, 231.31; 40/650, 40/651, 661.12, 599
See application file for complete search history.

(56) References Cited

U.S. PATENT DOCUMENTS

| | | | | | |
|---|---|---|---|---|---|
| 2,383,881 | A | * | 8/1945 | Murphy | 40/607.12 |
| 2,795,527 | A | | 6/1957 | Heyer | |
| 3,894,707 | A | * | 7/1975 | Heard | 248/230.9 |
| 4,300,299 | A | * | 11/1981 | Batky et al. | 40/607.03 |
| 4,344,244 | A | | 8/1982 | Tyke | |
| 4,408,922 | A | * | 10/1983 | D'Alessio | 403/12 |
| 4,548,377 | A | * | 10/1985 | Huel | 248/219.1 |
| 4,955,153 | A | | 9/1990 | Albrecht et al. | |
| 5,417,458 | A | | 5/1995 | Best | |
| 5,428,913 | A | * | 7/1995 | Hillstrom | 40/604 |
| 5,560,131 | A | * | 10/1996 | Gibson | 40/607.12 |
| 5,590,504 | A | * | 1/1997 | Heard et al. | 52/836 |
| 6,092,841 | A | | 7/2000 | Best | |
| 6,119,385 | A | | 9/2000 | Olivier et al. | |
| 6,186,454 | B1 | * | 2/2001 | Olsen | 248/218.4 |
| 6,241,287 | B1 | | 6/2001 | Best | |
| 6,364,099 | B2 | | 4/2002 | Emoff | |
| 6,411,215 | B1 | | 6/2002 | Shnier | |
| 6,481,811 | B1 | * | 11/2002 | Marsh | 312/333 |
| 6,525,659 | B2 | | 2/2003 | Jaffe et al. | |
| 6,550,170 | B1 | * | 4/2003 | Cooper et al. | 40/607.12 |
| 6,948,272 | B1 | | 9/2005 | Olivier et al. | |
| 7,383,654 | B2 | | 6/2008 | Olivier et al. | |
| 7,565,760 | B2 | * | 7/2009 | Maier-Hunke | G09F 7/08 211/70.6 |
| 7,588,224 | B2 | | 9/2009 | Bates et al. | |

(Continued)

FOREIGN PATENT DOCUMENTS

| | | | | | |
|---|---|---|---|---|---|
| GB | 176590 | A | * | 3/1922 | B60R 13/105 |

OTHER PUBLICATIONS

Patent Cooperation Treaty, International Preliminary Report on Patentability, International application No. PCT/US13/47048, Jun. 23, 2014.

(Continued)

*Primary Examiner* — Joanne Silbermann
(74) *Attorney, Agent, or Firm* — Flachsbart & Greenspoon, LLC

(57) ABSTRACT

A display assembly may be fitted with display advertisements. The assembly may be affixed to pre-existing cooler doors, including those that do not permit a bracket to completely surround it.

9 Claims, 12 Drawing Sheets

(56) References Cited

U.S. PATENT DOCUMENTS

| | | | | |
|---|---|---|---|---|
| 7,762,022 | B2 | 7/2010 | Stadler et al. | |
| 7,784,208 | B2 * | 8/2010 | Thompson | G09F 7/00 16/404 |
| 7,946,547 | B2 | 5/2011 | Bernstorf et al. | |
| 8,336,837 | B2 | 12/2012 | Gephart et al. | |
| 8,376,298 | B2 | 2/2013 | McPheeters | |
| 8,528,939 | B2 | 9/2013 | Turner | |
| 2001/0013186 | A1 | 8/2001 | Malitas | |
| 2007/0253208 | A1 * | 11/2007 | Howard et al. | 362/431 |
| 2008/0235911 | A1 | 10/2008 | Olivier | |
| 2009/0056185 | A1 * | 3/2009 | Wamsley | G06F 7/00 40/611.12 |
| 2010/0154265 | A1 * | 6/2010 | Poulokefalos | 40/661.05 |
| 2010/0236111 | A1 * | 9/2010 | Cheetwood | 40/124 |

OTHER PUBLICATIONS

Article 34 Amendments submitted in PCT application No. PCT/US13/47048, submitted May 20, 2014.

Patent Cooperation Treaty, International Search Report (PCT Article 18 and Rules 43 and 44), International application No. PCT/US 13/47048, Feb. 21, 2014.

* cited by examiner

DISPLAY FOR MULTIPLE TYPES OF DOOR HANDLES

This application claims the benefit of U.S. Provisional Application No. 61/502,432, filed Jun. 29, 2011.

TECHNICAL FIELD OF THE INVENTION

The present invention relates generally to display advertising surfaces, and more specifically to assemblies that are added to or combined with pre-existing door handles.

BACKGROUND OF THE INVENTION

The placing of display advertisements near consumer shelf space is generally known. Of late, retailers and advertisers have placed display ads on surfaces associated with the door handles of refrigeration coolers. For example, U.S. Pat. No. 7,383,654 describes an assembly that replaces entirely a cooler door handle, such as on the cooler aisle of a grocery or convenience store. On the assembly, there is a surface within a cavity that allows the interchanging of graphic displays, including advertisements. The assembly is mounted directly to the door itself after the pre-existing handle is removed.

There are several advantages to these kinds of assemblies. They allow ads to receive consumer attention at or near the moment of purchase. They also allow for quick and easy advertisement changes.

What is needed is an assembly that does not require replacement of a door handle. What is also needed is a capacity to mate a display advertising surface with the wide variety of legacy door handles that currently exist at retail point of sale locations. What is further needed is a capacity to mate a display advertising surface with a door handle type that does not permit a bracket to surround its axis for the full three hundred sixty degrees.

SUMMARY OF THE INVENTION

The present invention eliminates the drawbacks of preexisting assemblies. In the embodiments described below, the invention includes bracket clips designed and shaped for preexisting legacy cooler door handles. In three of the embodiments below, the bracket clips are for handles that allow a full three hundred sixty degree wrap-around. In a fourth embodiment, the bracket clip is for handles that do not permit such a wrap-around, for example a full-length L-bar. Other features and advantages of the present invention will become apparent from the detailed description below.

DETAILED DESCRIPTION

The present invention is described below in its various embodiments and configurations. The description is not intended to be limiting, and instead the appended claims alone describe the metes and bounds of the rights under the present invention.

Figure 1:
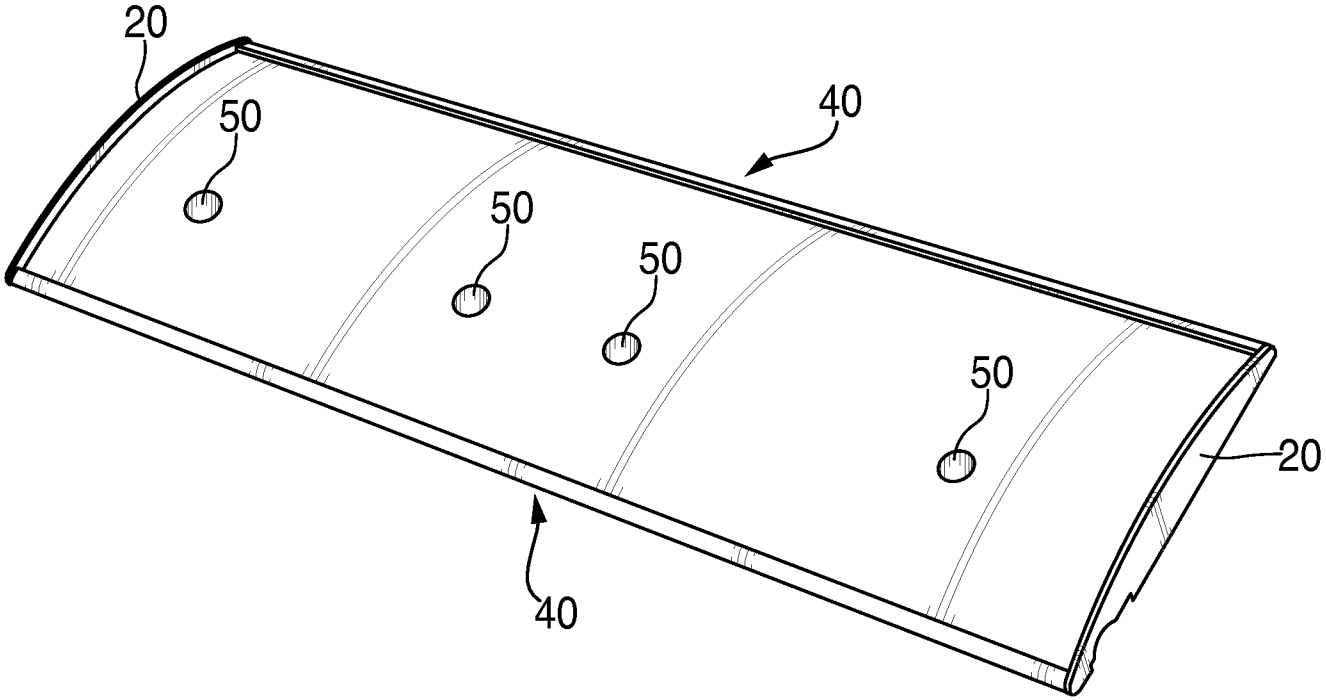
FIG. 1 is an elevation view of the front of a fully assembled display assembly, minus any display insert.

FIG. 1 shows an elevation view of the front of a fully assembled display assembly 10, minus any display insert. There is a top end cap 20 and a bottom end cap 30 inserted into the respective top and bottom of the display assembly. The display assembly 10 is generally rectangular, and in this embodiment has a convexly curved surface. Along each side of the curved surface is a lip flange 40. When one of the end caps is removed (e.g., the top), a display ad and its optional clear flexible cover (e.g., of thin transparent plexiglass) may be inserted into the display assembly. The end cap is then replaced. The display ad is thereby held in by the lip flange 40 and the respective end caps 20, 30. FIG. 1 also shows apertures 50 for receiving fastening screws 55 for the various kinds of brackets, to be described below.

Figure 2:
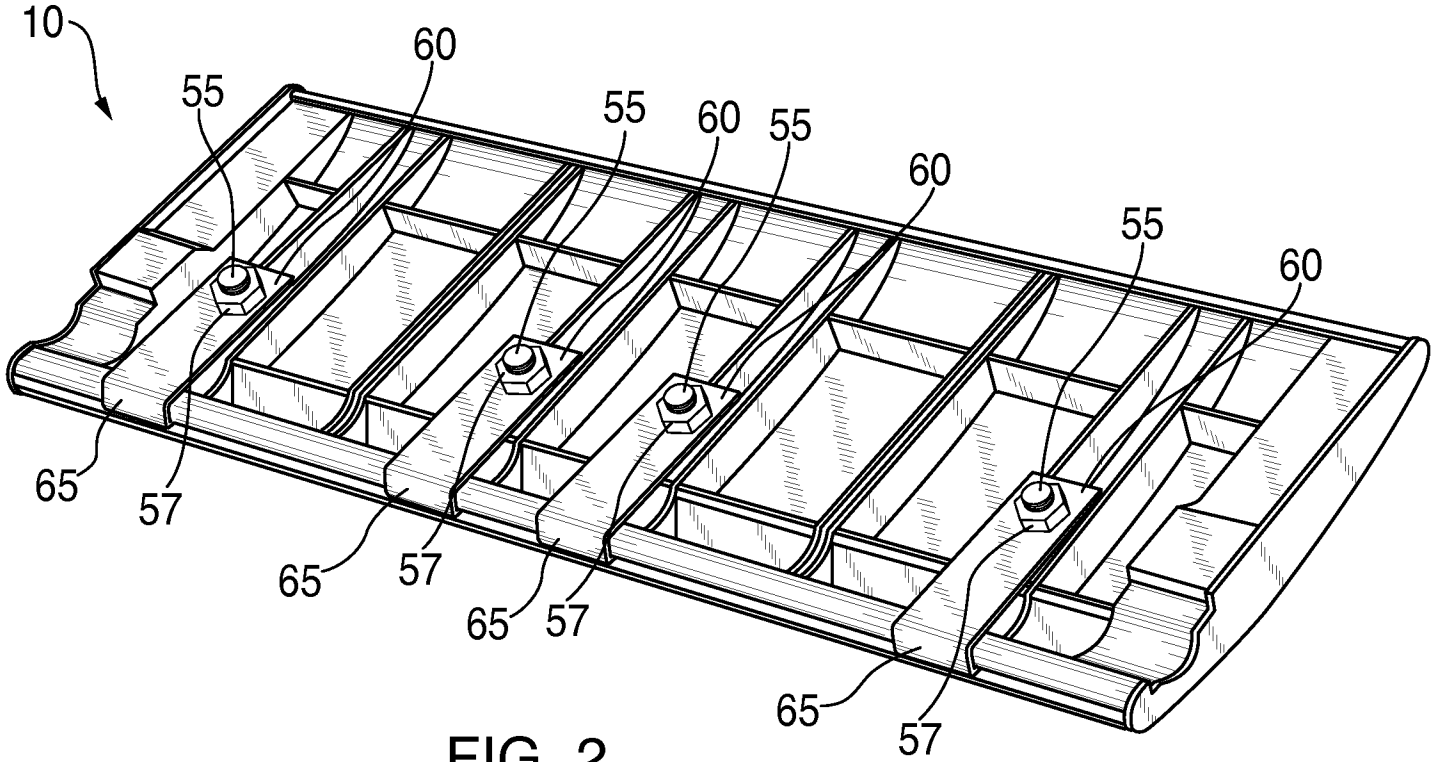
FIG. 2 is an elevation view of the rear of a fully assembled display assembly using a first bracket type to surround a first type of legacy handle.
Figure 9:
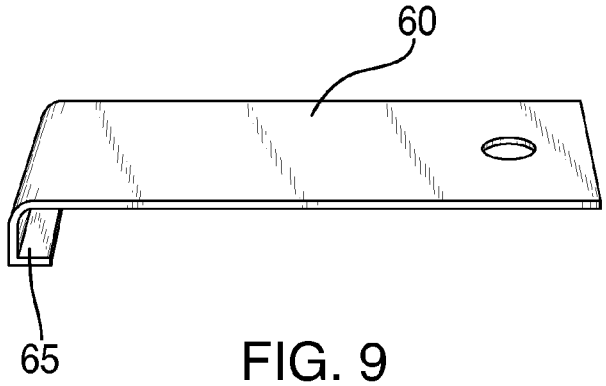
FIG. 9 is a perspective view of the individual brackets for the embodiment of FIGS. 2 and 5.

FIG. 2 is an elevation view of the rear of a fully assembled display assembly 10 using a first bracket type to surround a first type of legacy handle (namely, certain cooler handles by manufacturers Anthony and Ardco). The specific brackets 60 for this embodiment are more fully disclosed in FIG. 9, and are seen to be generally flat, with a J-shaped slot-fitting end 65. Opposite the slot-fitting end 65 is an aperture for receiving the above-mentioned fastening screw 55.

Figure 3:
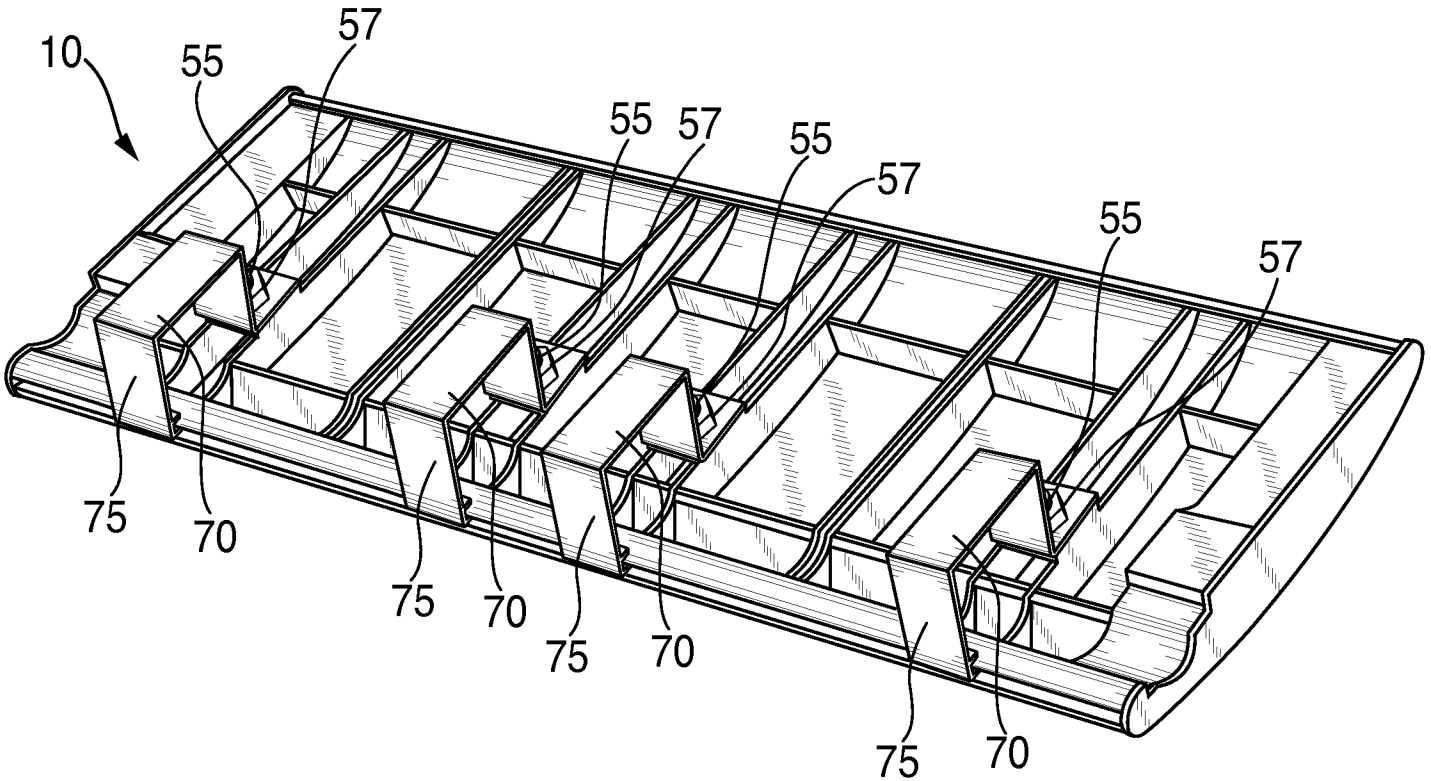
FIG. 3 is an elevation view of the rear of a fully assembled display assembly using a second bracket type to surround a second type of legacy handle.
Figure 10:
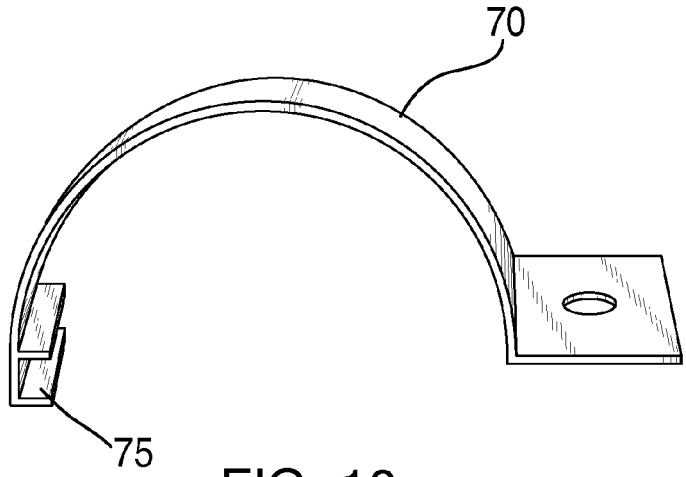
FIG. 10 is a perspective view of the individual brackets for the embodiment of FIGS. 3 and 6.

FIG. 3 is an elevation view of the rear of a fully assembled display assembly 10 using a second bracket type to surround a second type of legacy handle (namely, certain cooler handles by manufacturer Anthony, particularly more recent models). The specific brackets 70 for this embodiment are more fully disclosed in FIG. 10, and are seen to form a generally rectangular open shape, with a slot-fitting end 75. Again, opposite the slot-fitting end 75 is an aperture for receiving the above-mentioned fastening screw 55.

Figure 4:
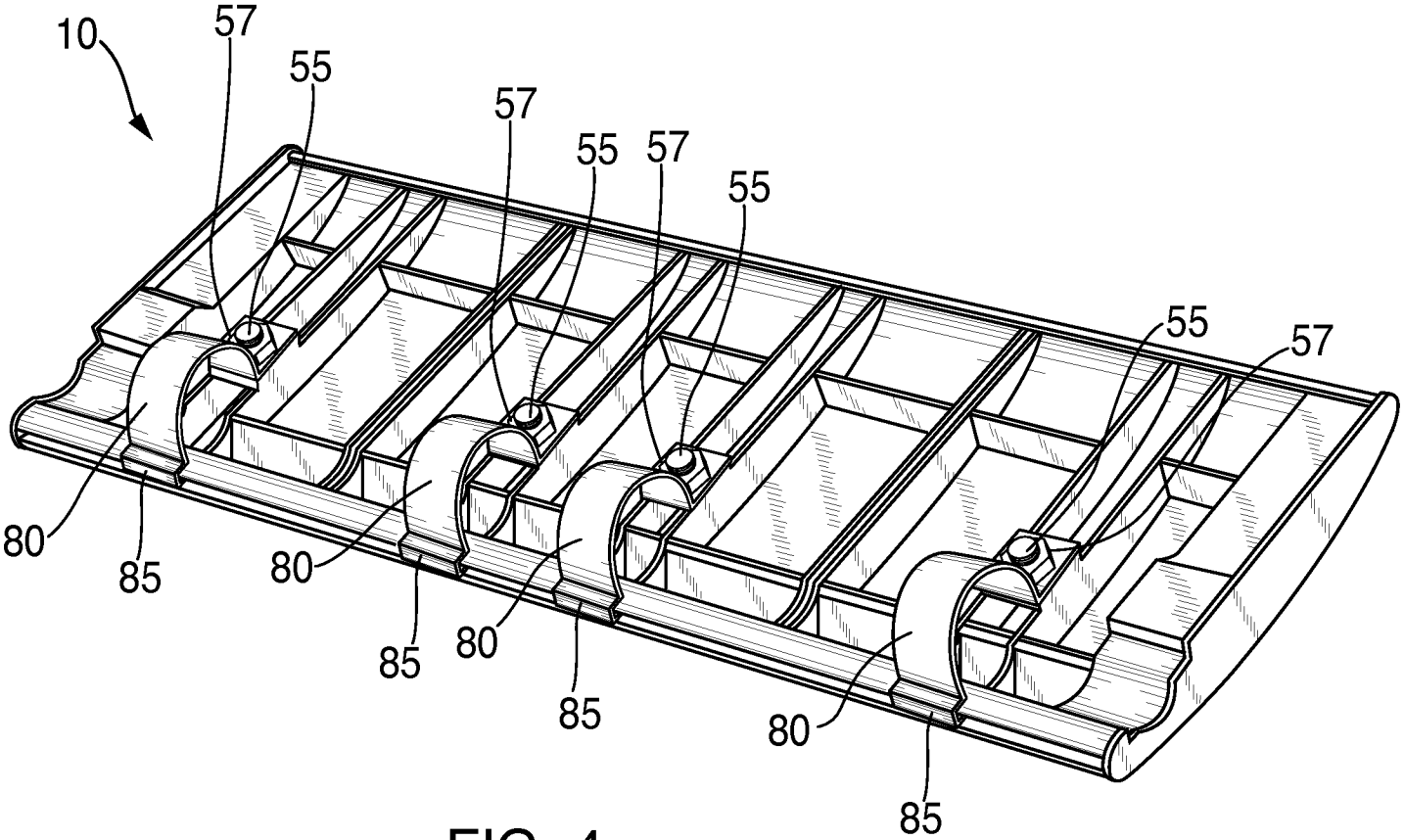
FIG. 4 is an elevation view of the rear of a fully assembled display assembly using a third bracket type to surround a third type of legacy handle.
Figure 11:
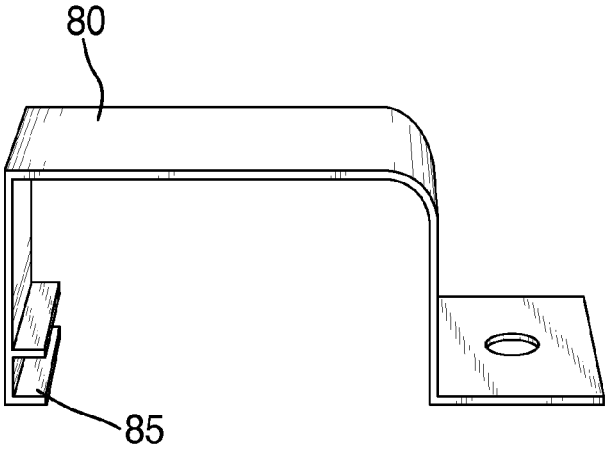
FIG. 11 is a perspective view of the individual brackets for the embodiment of FIGS. 4 and 7.

FIG. 4 is an elevation view of the rear of a fully assembled display assembly 10 using a third bracket type to surround a third type of legacy handle (namely, certain cooler handles by manufacturer Hussman). The specific brackets 80 for this embodiment are more fully disclosed in FIG. 11, and are seen to form a generally rounded, open C-shape, with a slot-fitting end 85. Again, opposite the slot-fitting end 85 is an aperture for receiving the above-mentioned fastening screw 55.

Figure 5:
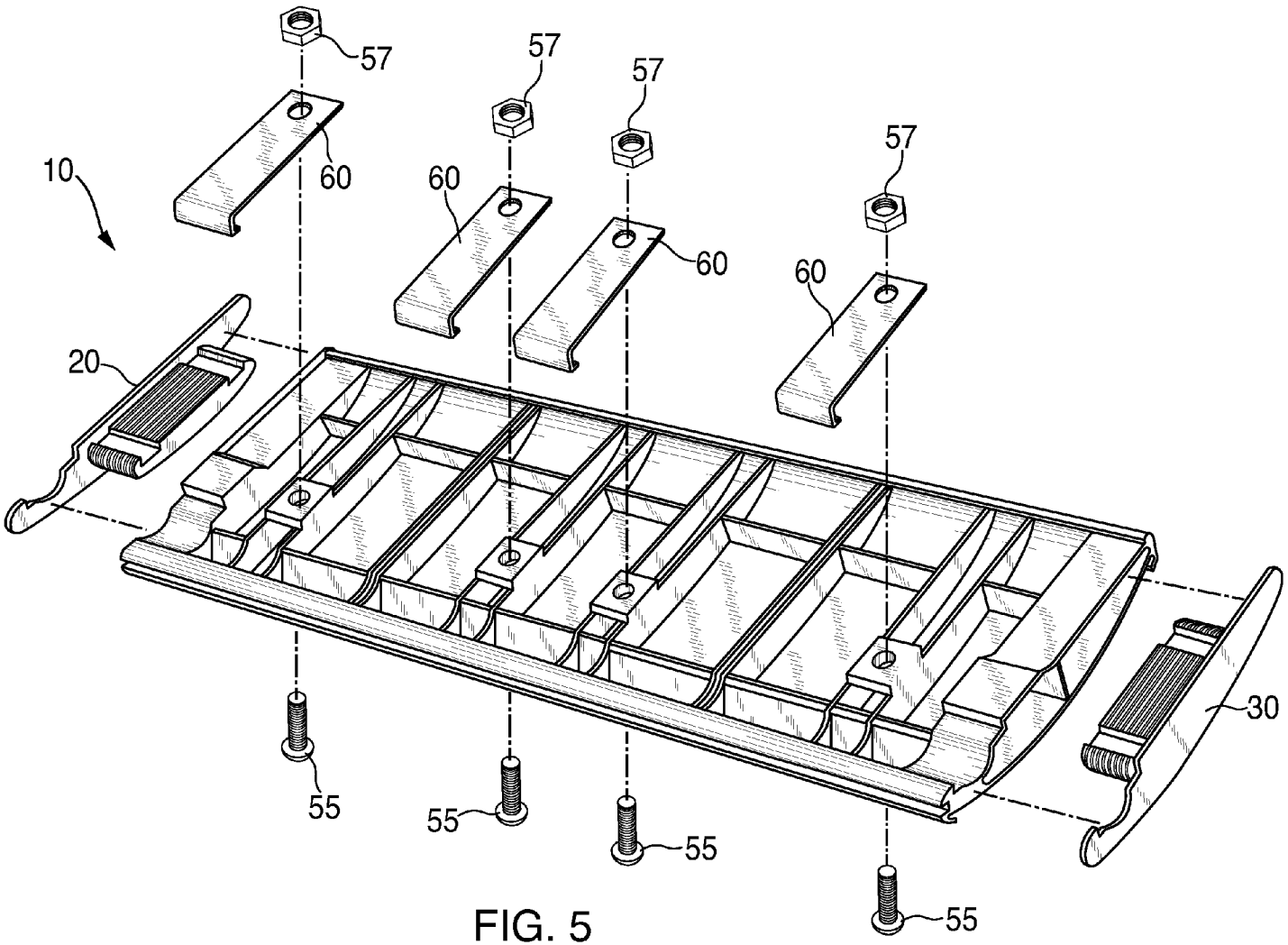
FIG. 5 is an exploded rear view of the assembly of FIG. 2.
Figure 6:
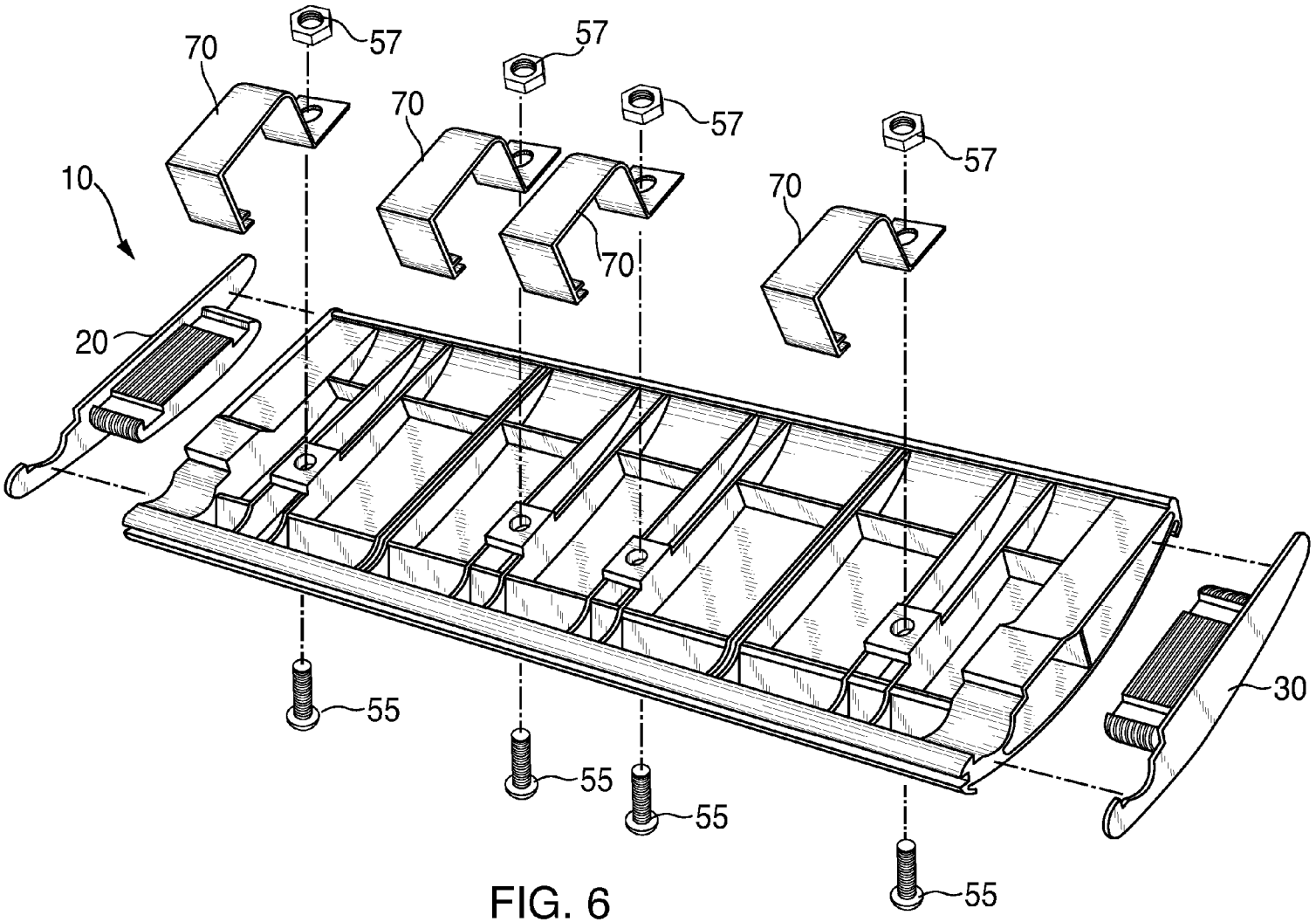
FIG. 6 is an exploded rear view of the assembly of FIG. 3.
Figure 7:
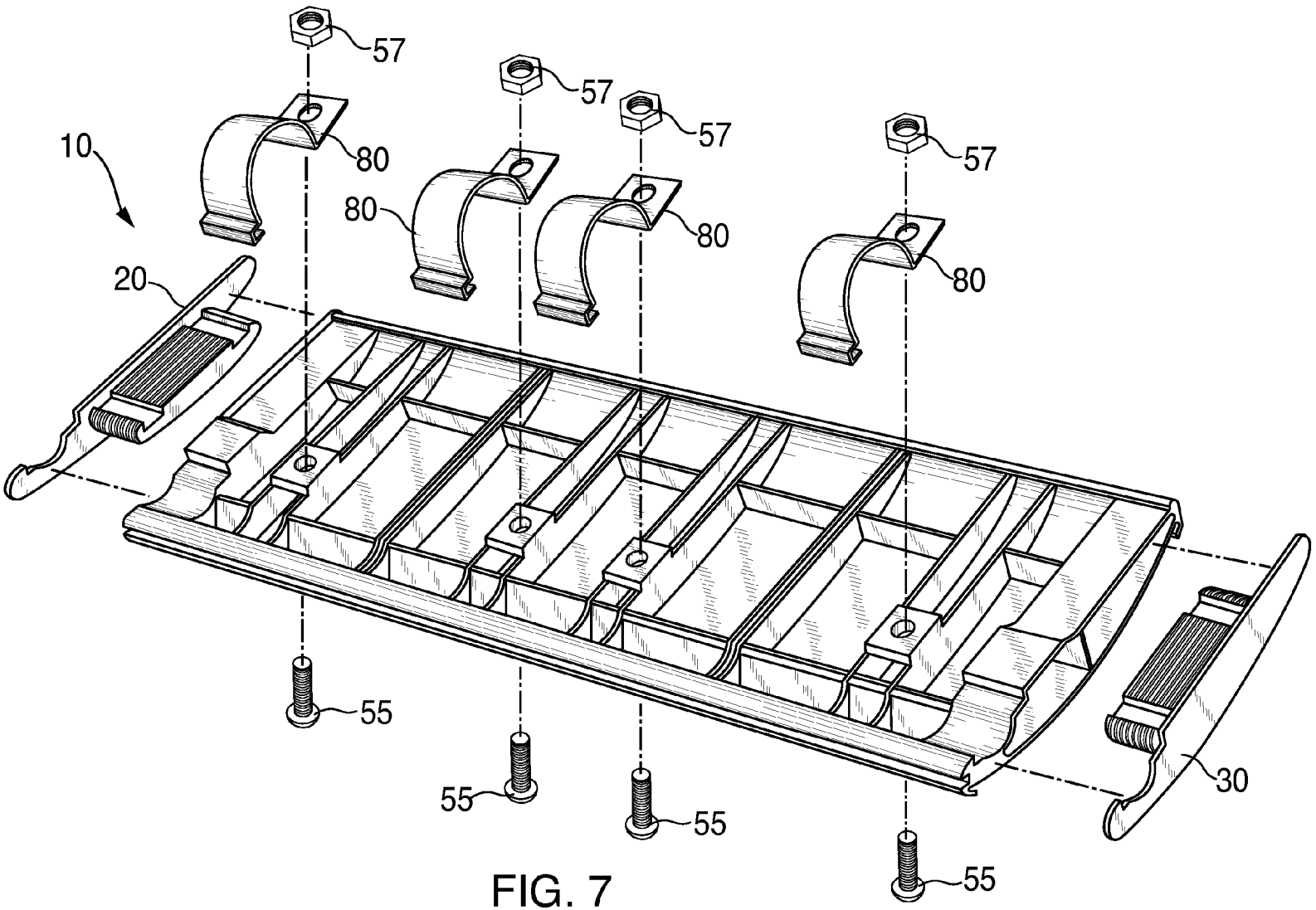
FIG. 7 is an exploded rear view of the assembly of FIG. 4.

FIGS. 5, 6 and 7 show perspective views depicting how the brackets 60, 70, 80 are attached to the display assemblies 10 of the present embodiments. The apertures on the front of the display assembly are larger than the ones on the back, such that a fastening screw 55 will pass completely through the front into the inner volume, so that its head rests flush against the back aperture. Then the respective bracket 60, 70, 80 is placed over the screw body, and the fastening nut 57 installed. In this way, a retailer or advertiser may easily install the display assembly 10 around the legacy door handle using conventional tools (such as a screwdriver and a wrench or needle pliers). Once installed, a consumer would pull on the display assembly 10 to open a cooler door, usually while looking right at it and its inserted-ad.

Figure 8:
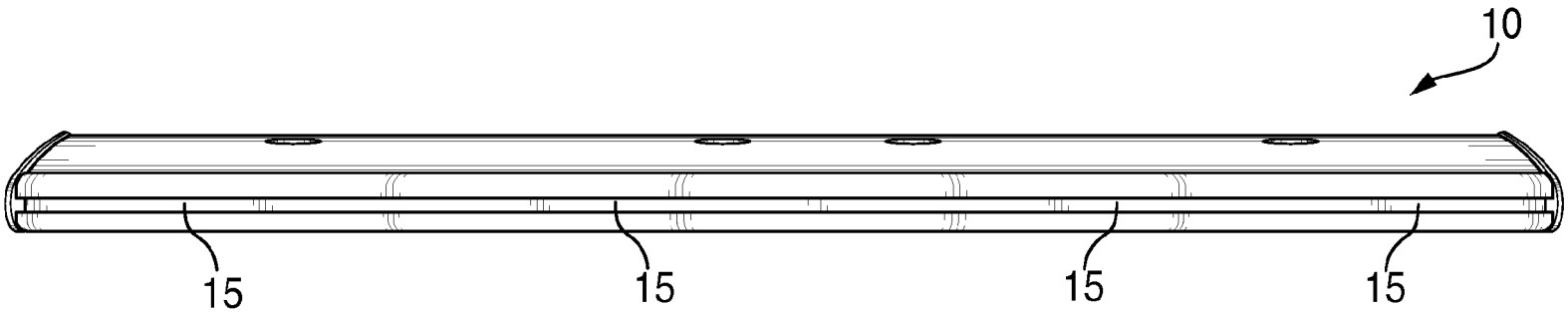
FIG. 8 is a side view of the assembly of the present invention.

FIG. 8 shows a side view of the display assembly 10, indicating where the slots 15 are for receiving the slot-fitting end 65, 75, 85 of the various brackets. It will be apparent that to affix the brackets 60, 70, 80, the slot-fitting end 65, 75, 85 is inserted into its slot, and then the screw 55 and bolt 57 are connected from the front to complete the connection. For the embodiments described so far, the final assembly will completely surround the legacy door handle.

Figure 12:
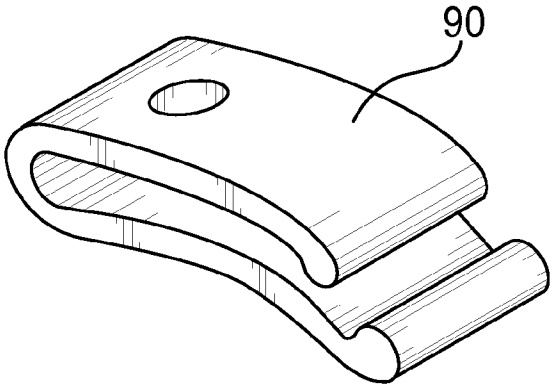
FIG. 12 is an elevation view of a different type of compatible bracket, for use as a clamp where a cooler door cannot be completely surrounded.

FIG. 12 is an elevation view of a different type of compatible bracket 90, for use as a clamp where a cooler door handle cannot be completely surrounded. It is assembled in the same way as the above-mentioned brackets, but results in an open tension-clamp, having bulbous ends. The embodiment of FIG. 12 is particularly useful for cooler door handle types like the full-length handles that may exist on the Anthony Model 101 cooler. Such handles are an L-shaped member running from top to bottom of the door, and thus do not allow brackets to completely surround them.

Figure 13:
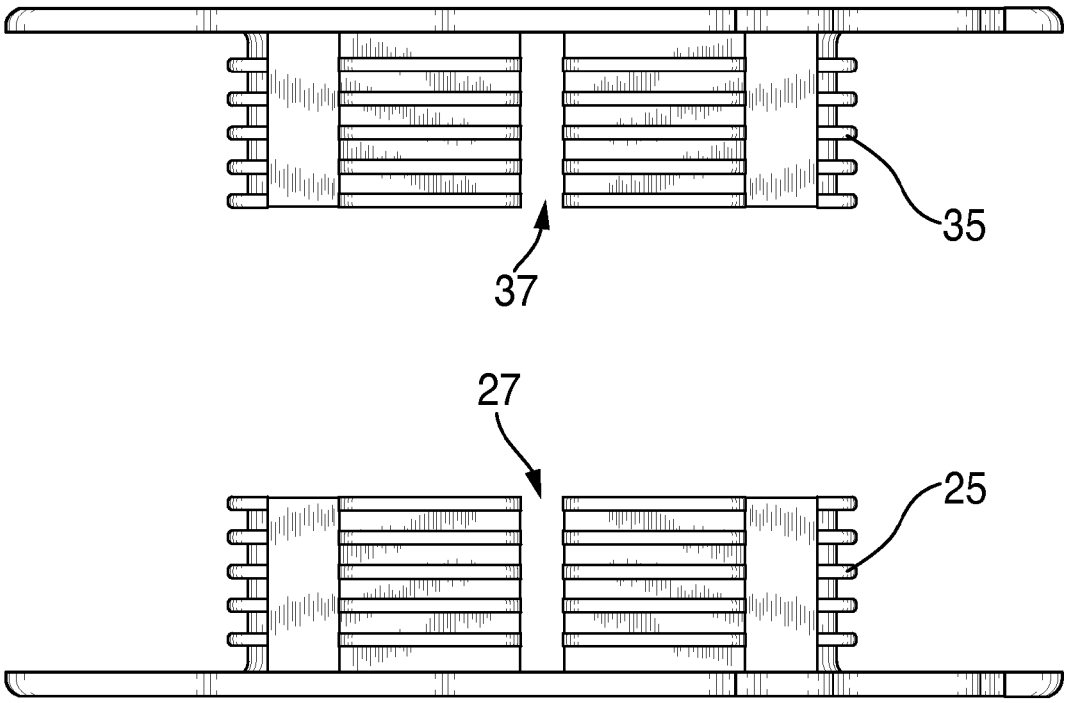
FIG. 13 is a side view of each end cap of the assembly of the present invention.
Figure 14:
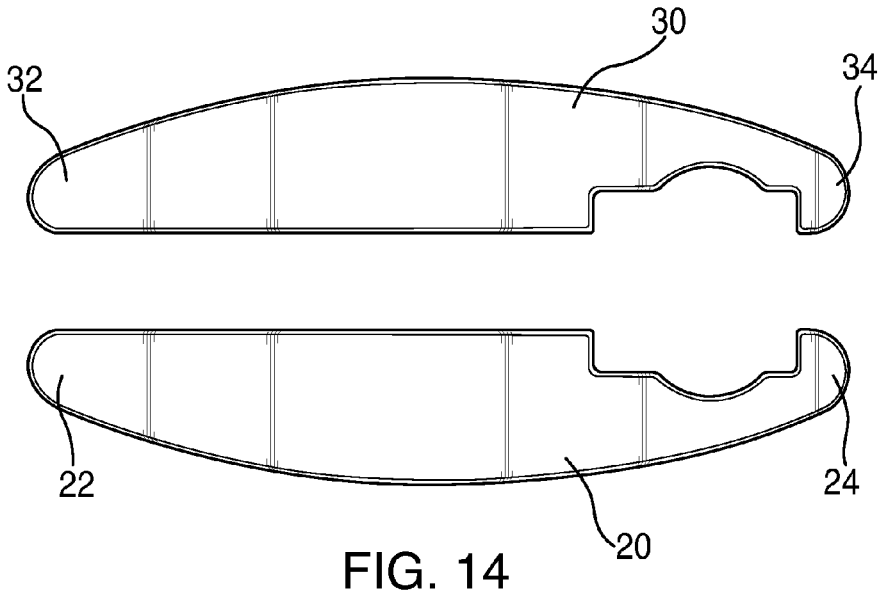
FIG. 14 is a top view of each end cap of the assembly of the present invention.

FIGS. 13 and 14 show, respectively, side and top views of the respective end caps (top 20 and bottom 30). These end caps 20, 30 are shaped asymmetrically to generally match the curved, asymmetrical cross section of the display assembly volume. They are inserted using a friction-fit. They each have two ends—distal 22, 32 from the bracket side, and proximal 24, 34 to the bracket side. Each end has projecting fin planes 25, 35 sized to allow a friction fit into the display assembly. Between the fin planes is an opening 27, 37 to allow passage into the volume of the display assembly, without interfering with a structural bar within such volume. The end caps may optionally be expanded in length, and fitted with electronics to provide battery-powered lighting displays, and/or sounds. Such lighting and sounds may be activated by proximity sensors, or by any other known means. In this way, the end caps may contribute even greater attention-attraction to the display assembly of the present invention.

Figure 15:
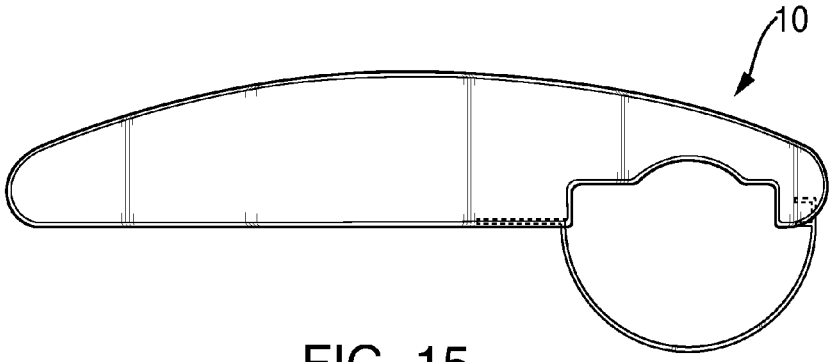
FIG. 15 is a top view of the assembly.
Figure 16:
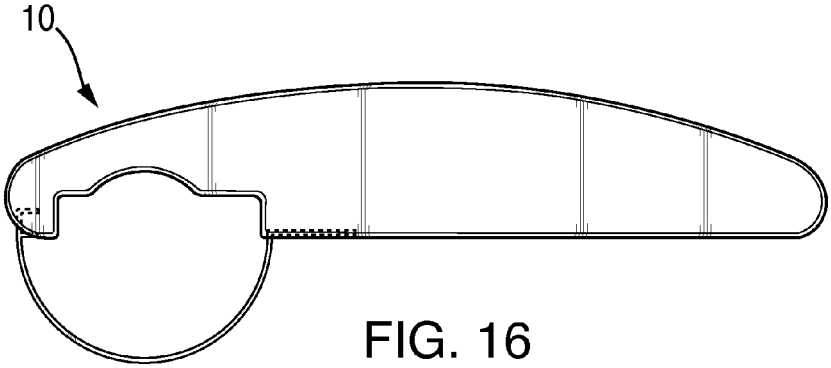
FIG. 16 is a bottom view of the assembly.

FIGS. 15 and 16 show, respectively, top and bottom views of the fully assembled display assembly 10. The asymmetry of the cross section, and its curvature from the proximal to the distal ends, are clearly indicated.

Figure 17:
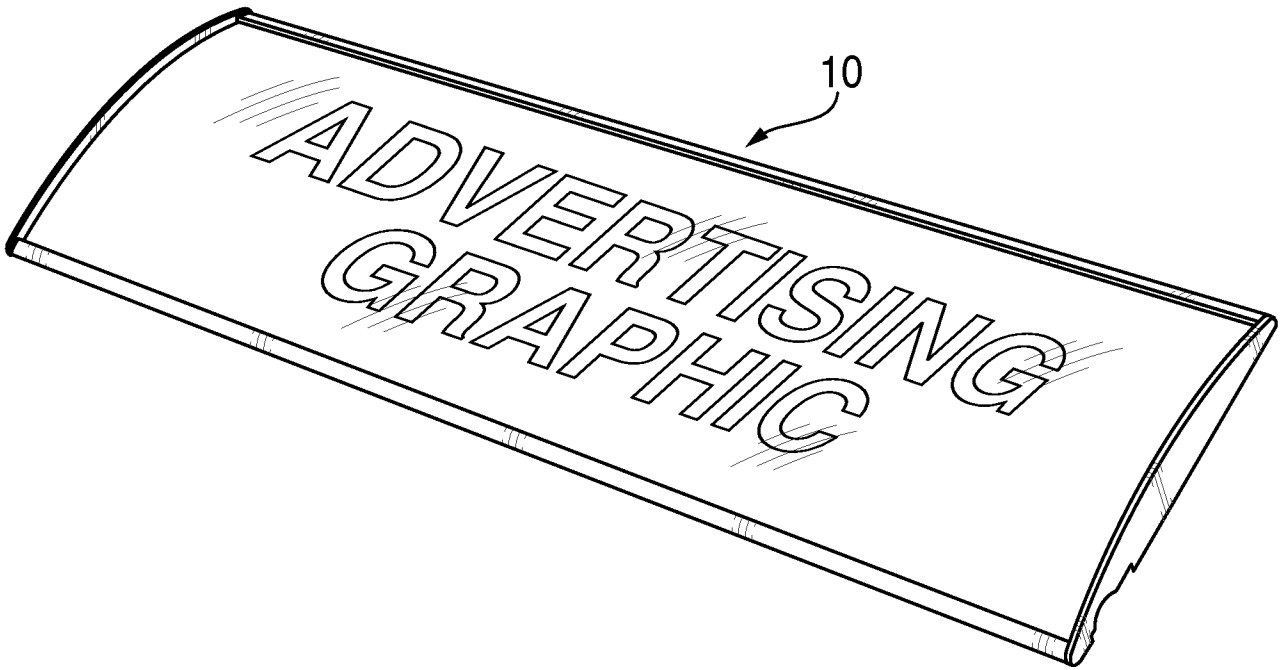
FIG. 17 is the assembly of FIG. 1, showing an exemplary display ad fully inserted.

FIG. 17 shows an elevation view of the front of the fully assembled display assembly 10 of the present invention, now equipped with an actual display ad. The display ad may be removed and replaced as desired by removing one of the end caps, and sliding the graphic material in and out over the front curved surface and under the lip flange. It will be appreciated that insertion of a display advertisement blocks any view of the screw apertures and screw head.

While the invention has been described with particular reference to specific embodiments, it will be apparent to those skilled in the art that the same principles may be used in similar arrangements. The invention is not limited to the precise structures described. Various changes and modifications may be made without departing from the spirit and scope of the invention as defined by the claims below.

I claim:

1. A system for displaying advertisements, comprising:

a display assembly comprising a front side, a rear side, and a slot edge, the front side surface comprising opposing lip flanges, for receiving a display advertisement insert, the rear side comprising one or more fastener-receiving apertures near the slot edge that pass through to the front side in a substantially perpendicular relationship to the front side, and the slot edge situated between the front side and rear side and comprising a bracket-receiving slot opening in the area between the front side and rear side;

a top end cap and a bottom end cap, comprising fins that engage the display assembly using a friction fit, and that cooperates with the lip flanges to contain said insert along the front side; and one or more removable and replaceable brackets affixable to the display assembly on the rear side through the fastener-receiving apertures and along the slot edge, for attaching the assembly to a pre-existing door handle, whereby upon receipt of the display advertisement insert, and attachment of the assembly to the preexisting door handle, no fastener or fastener-receiving apertures are visible to a user of the preexisting door handle from the front or from the side.

2. The system of claim 1 wherein the bracket comprises a tension clamp with bulbous ends, whereby it may engage a door handle that cannot be completely surrounded.

3. The system of claim 1 wherein the affixable bracket comprises a slot-fitting end fitted into the slot opening of the bracket-receiving slot and is affixed to the display assembly through the fastener-receiving aperture, whereby such bracket may cooperate with part of the rear side to completely surround a preexisting door handle and attach the display assembly to such door handle.

4. The system of claim 3 wherein the bracket comprises a substantially flat surface that cooperates with part of the rear side to create a volume to completely surround a preexisting door handle.

5. The system of claim 3 wherein the bracket comprises a substantially rectilinear loop surface that cooperates with part of the rear side to create a volume to completely surround a preexisting door handle.

6. The system of claim 3 wherein the bracket comprises a substantially curvilinear loop surface that cooperates with part of the rear side to create a volume to completely surround a preexisting door handle.

7. The system of claim 1 further comprising a display advertisement insert received into the display assembly, wherein the insert blocks view of the fastener or fastener-receiving apertures from a user of the preexisting door handle from the front or from the side.

8. A method of displaying advertisements comprising (a) affixing one or more brackets to the display assembly of claim 1 through one or more of the fastener receiving apertures in a manner that the one or more brackets clamp to or enclose a preexisting door handle;

(b) inserting a display advertisement insert into the display assembly of claim 1 wherein the insert blocks view of the fastener or fastener-receiving apertures from a user of the preexisting door handle from the front or from the side; and (c) attaching one or more of the end caps of claim 1 to the display assembly of claim 1, whereby the display advertisement insert is securely received.

9. The method of claim 8 further comprising during the affixing step: fitting an end of the one or more brackets into the slot opening so that the one or more brackets encloses a preexisting door handle.

* * * * *